US009788703B2

(12) United States Patent
Beidler et al.

(10) Patent No.: US 9,788,703 B2
(45) Date of Patent: Oct. 17, 2017

(54) DISHWASHER WITH RECHARGEABLE COMPONENTS

(71) Applicant: Whirlpool Corporation, Benton Harbor, MI (US)

(72) Inventors: Eric M. Beidler, Watervliet, MI (US); Paul E. Beshears, Jr., Stevensville, MI (US); David H. Chen, Saint Joseph, MI (US); Eric A. Gallagher, Kalamazoo, MI (US); Antony M. Rappette, Benton Harbor, MI (US); Elliott V. Stowe, Stevensville, MI (US)

(73) Assignee: Whirlpool Corporation, Benton Harbor ( * ) Notice: Subject to any disclaimer, the term of this patent is extended or adjusted under 35 U.S.C. 154(b) by 736 days.

(21) Appl. No.: 13/789,747

(22) Filed: Mar. 8, 2013

(65) Prior Publication Data

US 2014/0251378 A1 Sep. 11, 2014

(51) Int. Cl.

| | |
|---|---|
| ***A47L 15/00*** | (2006.01) |
| ***A47L 15/42*** | (2006.01) |
| ***A47L 15/46*** | (2006.01) |
| ***A47L 15/50*** | (2006.01) |
| ***A47L 15/44*** | (2006.01) |

(52) U.S. Cl.

CPC ..... *A47L 15/0047* (2013.01); *A47L 15/42* (2013.01); *A47L 15/44* (2013.01); *A47L 15/50* (2013.01); *A47L 15/46* (2013.01); *A47L 2401/34* (2013.01); *A47L 2501/36* (2013.01)

(58) Field of Classification Search

CPC ..... A47L 15/44; A47L 15/50

See application file for complete search history.

(56) References Cited

U.S. PATENT DOCUMENTS

| | | | | |
|---|---|---|---|---|
| 5,839,097 | A | 11/1998 | Klausner | |
| 6,295,004 | B1 | 9/2001 | Burnett | |
| 6,955,067 | B2 | 10/2005 | Davenet et al. | |
| 7,594,513 | B2 | 9/2009 | Vanderroest et al. | |
| 2002/0088502 | A1 | 7/2002 | Van Rompuy et al. | |
| 2009/0194562 | A1 | 8/2009 | Kessler et al. | |
| 2010/0126526 | A1 * | 5/2010 | Poyner | A47L 15/0049 134/18 |
| 2010/0132748 | A1 | 6/2010 | Kessler et al. | |
| 2010/0163085 | A1 | 7/2010 | Langford et al. | |

(Continued)

FOREIGN PATENT DOCUMENTS

| | | | |
|---|---|---|---|
| DE | 4438373 | A1 | 5/1996 |
| EP | 1218584 | B1 | 5/2006 |

(Continued)

OTHER PUBLICATIONS

German Search Report for Counterpart DE102014100799.9, dated Sep. 22, 2014.

*Primary Examiner* — Jason Ko
*Assistant Examiner* — Spencer Bell
(74) *Attorney, Agent, or Firm* — McGarry Bair PC

(57) ABSTRACT

A dishwasher for treating dishes according to an automatic cycle of operation having a tub that at least partially defines a treating chamber, a slidable dish holder, an electricity-consuming component having a rechargeable battery, and a battery charging system to recharge the rechargeable battery of the electricity-consuming component when the dish holder is in the treating position.

9 Claims, 5 Drawing Sheets

(56) References Cited

U.S. PATENT DOCUMENTS

| | | | | |
|---|---|---|---|---|
| 2011/0132411 | A1 | 6/2011 | Kessler et al. | |
| 2011/0139816 | A1 | 6/2011 | Kessler et al. | |
| 2011/0139818 | A1 | 6/2011 | Kessler et al. | |
| 2011/0139820 | A1 | 6/2011 | Kessler et al. | |
| 2011/0174341 | A1 | 7/2011 | Kessler et al. | |
| 2011/0174346 | A1 | 7/2011 | Kessler et al. | |
| 2011/0204096 | A1 | 8/2011 | Kessler et al. | |
| 2011/0215689 | A1 | 9/2011 | Wegener et al. | |
| 2011/0248609 | A1* | 10/2011 | Hopfl ..... | A47L 15/006 312/228 |
| 2011/0315709 | A1 | 12/2011 | Fileccia et al. | |
| 2012/0017953 | A1 | 1/2012 | Fileccia et al. | |
| 2012/0018451 | A1 | 1/2012 | Fileccia et al. | |
| 2012/0031930 | A1 | 2/2012 | Fileccia et al. | |
| 2012/0032514 | A1 | 2/2012 | Alberghetti et al. | |
| 2012/0222712 | A1 | 9/2012 | Bastigkeit et al. | |

FOREIGN PATENT DOCUMENTS

| | | | |
|---|---|---|---|
| EP | 2581026 | A2 | 4/2013 |
| FR | 2940037 | A1 | 6/2010 |
| JP | 2009112487 | A | 5/2009 |
| WO | 2010015367 | A2 | 2/2010 |

* cited by examiner

DISHWASHER WITH RECHARGEABLE COMPONENTS

BACKGROUND OF THE INVENTION

Dishwashers can include a plurality of components that are collectively controlled by a controller to treat dishes within a treating chamber according to an automatic cycle of operation. Those components that require electricity are typically located such that the electrical supply is external to the treating chamber, such as mounting the components to a tub or door, which collectively define a closed treating chamber. For example, a treating chemistry dispenser may be provided to the interior portion of the door assembly for controlling the dispensing of the treating chemistry, and the electrical supply for the dispenser may be disposed in the interior of the door.

SUMMARY OF THE INVENTION

The invention relates to a dishwasher for treating dishes according to an automatic cycle of operation having a tub; a dish holder; an electricity-consuming component provided on the dish holder and having a rechargeable battery; and a battery charging system supplying electricity to the rechargeable battery and having an electrical conduit having a first connector carried with the dish holder and a second connector provided with one of the multiple walls, wherein the first and second connectors are disconnected and prevent the supply of electricity through the electrical conduit when the dish holder is in the loading position and the first and second connectors are connected to permit the supply of electricity through the electrical conduit when the dish holder is in the treating position to recharge the rechargeable battery.

DESCRIPTION OF EMBODIMENTS OF THE INVENTION

Figure 1:
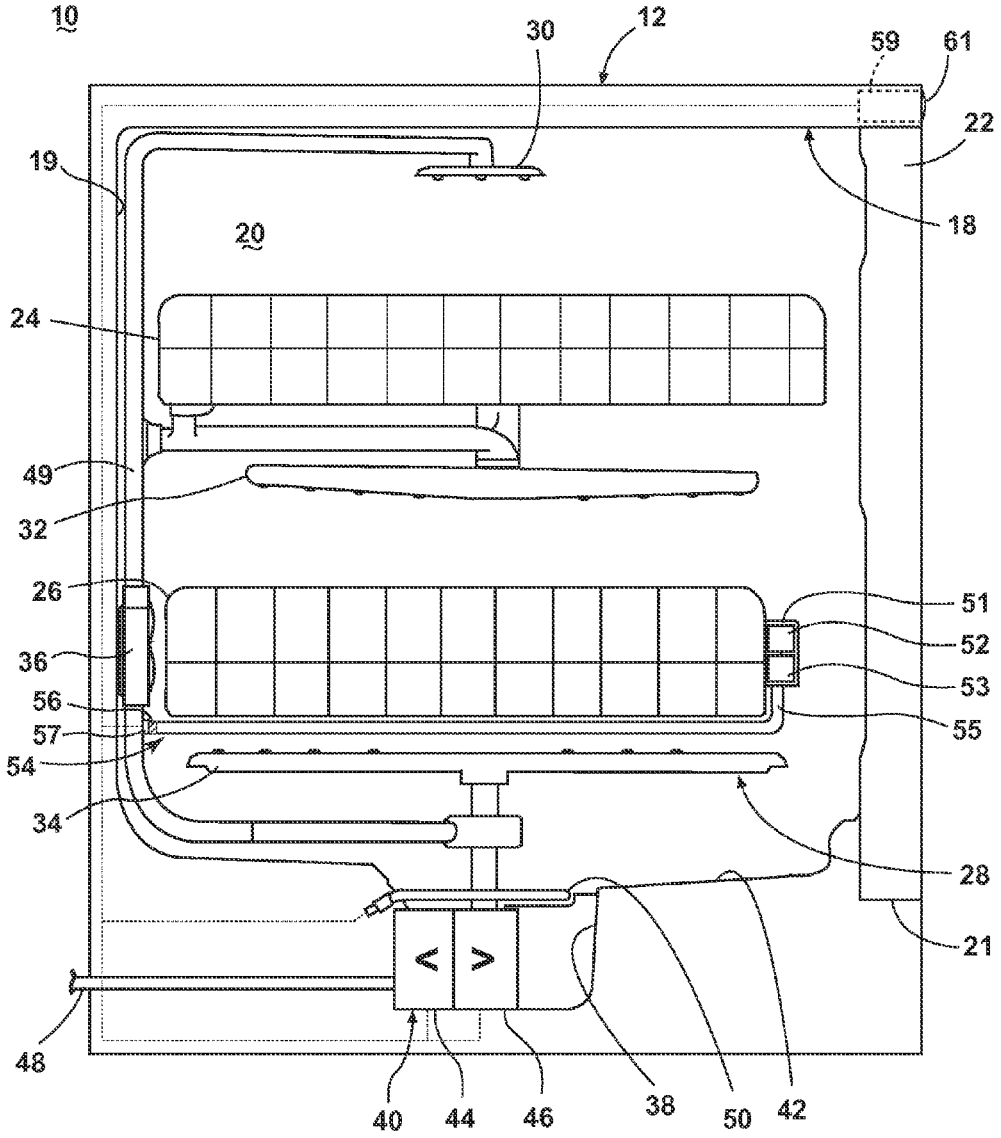
FIG. 1 is a schematic, side view of a dishwasher according to a first embodiment of the invention, wherein the dishwasher is in a treating position.

FIG. 1 is a schematic, side view of a dishwasher 10 in a treating position according to one embodiment of the invention. The dishwasher 10 shares many features of a conventional automated dishwasher, which will not be described in detail herein except as necessary for a complete understanding of the invention. The dishwasher 10 has a housing, which may include a cabinet or chassis 12 that may define an interior of the dishwasher 10. The dishwasher housing may also include a frame (not shown), with or without panels mounted to the frame. An open-faced tub 18 having side walls and rear wall 19 may be mounted to the dishwasher housing and provided within the cabinet 12, and may at least partially define a treating chamber 20, having an open face 21 defining an access opening, for treating dishes. A door assembly 22 may be movably mounted to the dishwasher 10 for movement between loading and treating positions to selectively open and close the open face 21 of the tub 18. Thus, the door assembly 22 provides accessibility to the treating chamber 20 for the loading and unloading of dishes or other washable items. When the door assembly 22 is closed, the door assembly 22 in combination with the tub defines a closed treating chamber 20 and user access to the treating chamber 20 may be prevented, whereas user access to the treating chamber 20 may be permitted when the door assembly 22 is open. While the present invention is described in terms of a conventional dishwashing unit, it could also be implemented in other types of dishwashing units, such as in-sink dishwashers, multi tub dishwashers, or drawer-type dishwashers.

Dish holders, illustrated in the form of upper and lower racks 24, 26, respectively, are located within the treating chamber 20 and receive dishes for storage during treating. The racks 24, 26 are typically mounted for slidable movement in and out of the treating chamber 20 for ease of loading and unloading. Other dish holders may be provided, such as a silverware basket in the tub 18. As used in this description, the term "dish(es)" is intended to be generic to any item, singular or plural, that may be treated in the dishwasher 10, including, without limitation; dishes, plates, pots, bowls, pans, glassware, and silverware. While not shown, other dish holders may be provided, such as a silverware basket on the interior of the door assembly 22 or a third level rack above the upper rack 24 may also be provided.

A spraying system 28 may be provided for spraying liquid in the treating chamber 20 and is provided in the form of an upper spray arm assembly 30, a mid-level spray arm assembly 32, a first lower spray assembly 34, and a second lower spray assembly 36. The upper spray arm assembly 30 may be located above the upper rack 24 and is illustrated as a fixed spray nozzle that sprays liquid downwardly within the treating chamber 20. Mid-level spray arm assembly 32 and first lower spray assembly 34 are located, respectively, beneath upper rack 24 and lower rack 26 and are illustrated as rotating sprayers. The liquid spray from the mid-level sprayer 32 may be sprayed downwardly, upwardly, or both, depending on the design requirement, to provide spray onto the lower rack 26, upper rack 24, or both, respectively. The mid-level spray arm assembly 32 may be coupled to the lower portion of the upper rack 24. The first lower spray assembly 34 may provide a liquid spray upwardly through the bottom of the lower rack 26.

The second lower spray assembly 36 may be fixedly mounted to the tub 18 adjacent to the lower rack 26 and may provide a liquid spray laterally through a side of the lower rack 26. The second lower spray assembly 36 may not be limited to this position; rather, it may be located in virtually any part of the treating chamber 20, as can the other sprayers. While not illustrated herein, the second lower spray assembly 36 may include multiple spray nozzles having apertures configured to spray wash liquid towards the lower rack 26. The second lower spray assembly 36 is illustrated as including a vertically oriented distribution header or spray manifold. Such a spray manifold is set forth in detail in U.S. Pat. No. 7,594,513, issued Sep. 29, 2009, and titled "Multiple Wash Zone Dishwasher," which is incorporated herein by reference in their entirety.

A recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46.

The drain pump 44 may draw liquid from the sump 40 and pump the liquid out of the dishwasher 10 to a household drain line 48. The recirculation pump 46 may draw liquid from the sump 40, and the liquid may be simultaneously or selectively pumped through a supply tube 49 to each of the assemblies 30, 32, 34, 36 for selective spraying. While the pump assembly 40 is illustrated as having separate drain and recirculation pumps 44, 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may be fluidly coupled with the recirculation system, and may include a water supply conduit coupled with a household water supply for supplying water to the treating chamber 20.

A heating system including a heater 50 may be located within or near the sump 38 for heating liquid contained in the sump 38. A filtering system (not shown) may be fluidly coupled with the recirculation flow path for filtering the recirculated liquid.

A dispensing system may be provided for storing and dispensing treating chemistry to the treating chamber 20. As illustrated in FIG. 1, the dispensing system can include a dispenser 51 provided on the lower rack 26. The dispenser 51 may be removably or non-removably mounted to the lower rack 26. The dispenser 51 may be configured to dispense one or more treating chemistries to the dishes within the treating chamber 20 during the cycle of operation. The dispenser 51 may be either or both a single use dispenser, which holds a single dose of treating chemistry, and a bulk dispenser which holds multiple doses of treating chemistry. The dispenser 51 may be a single-use dispenser for some of the treating chemistries and a bulk dispenser for other of the treating chemistries. While shown as being mounted to the front end portion of the lower dish rack 26, it may be noted that the dispenser 51 may also be positioned at any other locations of the upper and lower dish racks 24, 26 and any other dish holder.

The dispenser 51 may itself be an electricity-consuming component 52, such as a controller, sensor or actuator, which may be used to dispense the treating chemistry. The actuator may be in the form of a solenoid valve, wax motor, pump or other actuators.

The dispenser 51 may further include a rechargeable battery 53 to supply power to the component 52. Non-limiting examples of the rechargeable battery 53 may include; lead-acid, nickel cadmium (NiCd), nickel metal hydride (NiMH), lithium ion (Li-ion), and lithium ion polymer (Li-ion polymer). It may be understood that the electricity for recharging the rechargeable battery 53 does not need to be at a high voltage level, which is generally 12 volts or higher in this type of application. Instead, the rechargeable battery 53 may be configured to be charged in a low voltage level, which is generally less than the operational voltage of the components of the dishwasher. For example, the rechargeable battery 53 may be supplied with the signal voltage level, which is typically five volts or less. That said, the signal voltage level of equal to or less than five volts may be provided to the rechargeable battery 53 for charging the rechargeable battery 53.

A battery charging system 54 may be provided for recharging the battery 53. The battery charging system 54 may include an electrical conduit 55, which has one end electrically coupled to the dispenser 51 and another end having a first electrical connector 56. The electrical conduit 55 and the first connector 56 may be carried by the lower rack 26.

The battery charging system 54 may further include a second electrical connector 57, which is illustrated in the rear wall 19 of the tub 18. The second connector 57 is coupled to an electricity source, such as from a controller 59, which is transferred to the electrical conduit 55 upon the coupling of the first and second connectors 56, 57, where the electricity is supplied to the battery 53 via the conduit 55.

The first and second connectors 56, 57 are connected when the lower rack 26 is in the treating position and uncoupled when the lower rack 26 is in the loading position. The sliding movement of the lower rack 26 between the loading and treating positions effects the coupling/uncoupling of the first and second connectors 56, 57. In this manner, electricity can be supplied to the battery when the lower rack 26 is in the treating position and the door assembly closes the treating chamber 20, which is the configuration of the dishwasher 10 when a cycle of operation is being implemented. While the second connector 57 is shown in the rear wall, it may be located on any of the walls of the tub, especially the side walls of the tub.

The controller 59 may be operably coupled with other various components of the dishwasher 10 to implement a cycle of operation. The controller 59 may be coupled to a traditional household power supply, typically AC power, and include suitable transformer circuitry to provide DC power to the various components that require DC power. The controller 59 may be located within the cabinet 12 as illustrated, or it may alternatively be located somewhere in the dishwasher 10. The controller 59 may be operably coupled with a control panel or user interface 61 for receiving user-selected inputs and communicating information to the user. The user interface 61 may include operational controls such as dials, lights, switches, and displays enabling a user to input commands, such as a cycle of operation, to the controller 59 and receive information.

Figure 2:
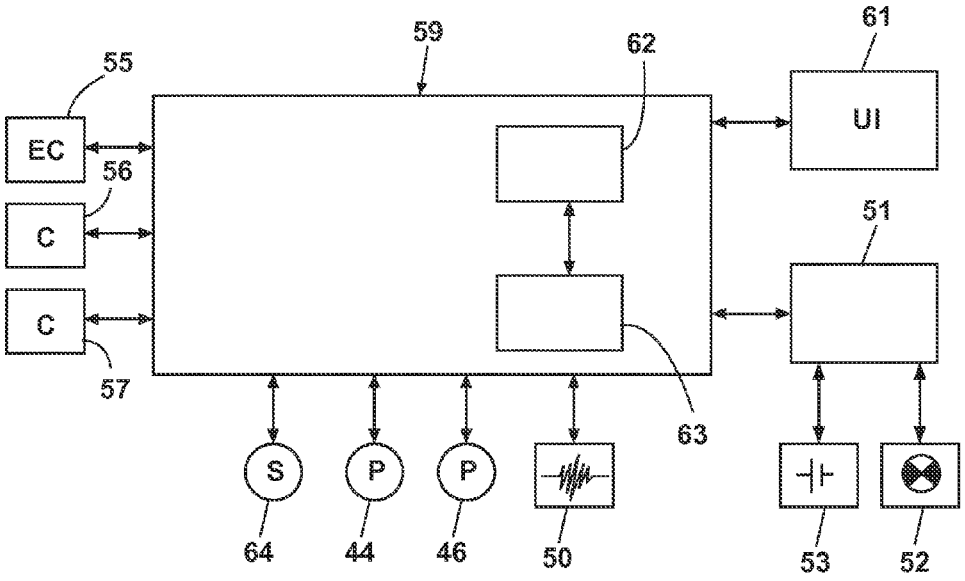
FIG. 2 is a schematic view of a controller of the dishwasher of FIG. 1.

As illustrated schematically in FIG. 2, the controller 59 may be coupled with the heater 50 for heating the wash liquid during a cycle of operation, the drain pump 44 for draining liquid from the treating chamber 20, and the recirculation pump 46 for recirculating the wash liquid during the cycle of operation. The controller 59 may be provided with a memory 62 and a central processing unit (CPU) 63. The memory 62 may be used for storing control software that may be executed by the CPU 63 in completing a cycle of operation using the dishwasher 10 and any additional software. For example, the memory 62 may store one or more pre-programmed cycles of operation that may be selected by a user and completed by the dishwasher 10. The controller 59 may also receive input from one or more sensors 64. Non-limiting examples of sensors that may be communicably coupled with the controller 59 include a temperature sensor, pH sensor, and turbidity sensor to determine the soil load associated with a selected grouping of dishes, such as the dishes associated with a particular area of the treating chamber 20.

The controller 59 may also be operably coupled to the dispenser 51 having the rechargeable battery 53 for selectively dispensing the treating chemistry in the treating chamber 20. The controller 59 may also be operably coupled to the electrical conduit 55, first electrical connector 56 and second electrical connector 57 for controlling the supply of electricity to the rechargeable battery 53 in the dispenser 51. While the controller 59 need not control the supply of electricity to the battery 53, it is possible for the controller to have a DC output, such as in the case of the controller 59 having a microprocessor with a signal output pin that is coupled to the electrical conduit 55. In this manner, the controller 59 may control the sending of a signal at signal voltage level to the conduit 55, which may be used to control the charging of the battery 53. The controller 59 can turn on/off the signal as needed to control the charging of the battery 53.

The controller 59 is used to implement the treating cycle of operation during which the dispenser 51 may be used and/or charged. Prior to the onset of the treating cycle of operation, both upper and lower racks 24, 26 may be loaded with dishes while in the loading position, and then moved to the treating position, as illustrated in FIG. 1, where the first and second connectors 56, 57 are coupled. The closure of the door assembly 22 prevents the movement of the racks 24, 26 from the treating to the loading positions, and essentially functions to keep the first and second connectors 60 in a position where they are electrically coupled. When the first and second electrical connectors 56, 57 are coupled, the battery 53 of the dispenser 51 may be automatically electrically coupled to the battery charging system 54.

During a cycle of operation where the dishwasher 10 may be in the treating position, the battery 53 in the dispenser 51 may be charged by the battery charging system 54. The dispenser 51 may dispense the treating chemistry while consuming electricity supplied from the rechargeable battery 53. For example, the actuator 52 in the dispenser 51 may consume electricity supplied from the rechargeable battery 53, while the rechargeable battery 53 is being charged.

Figure 3:
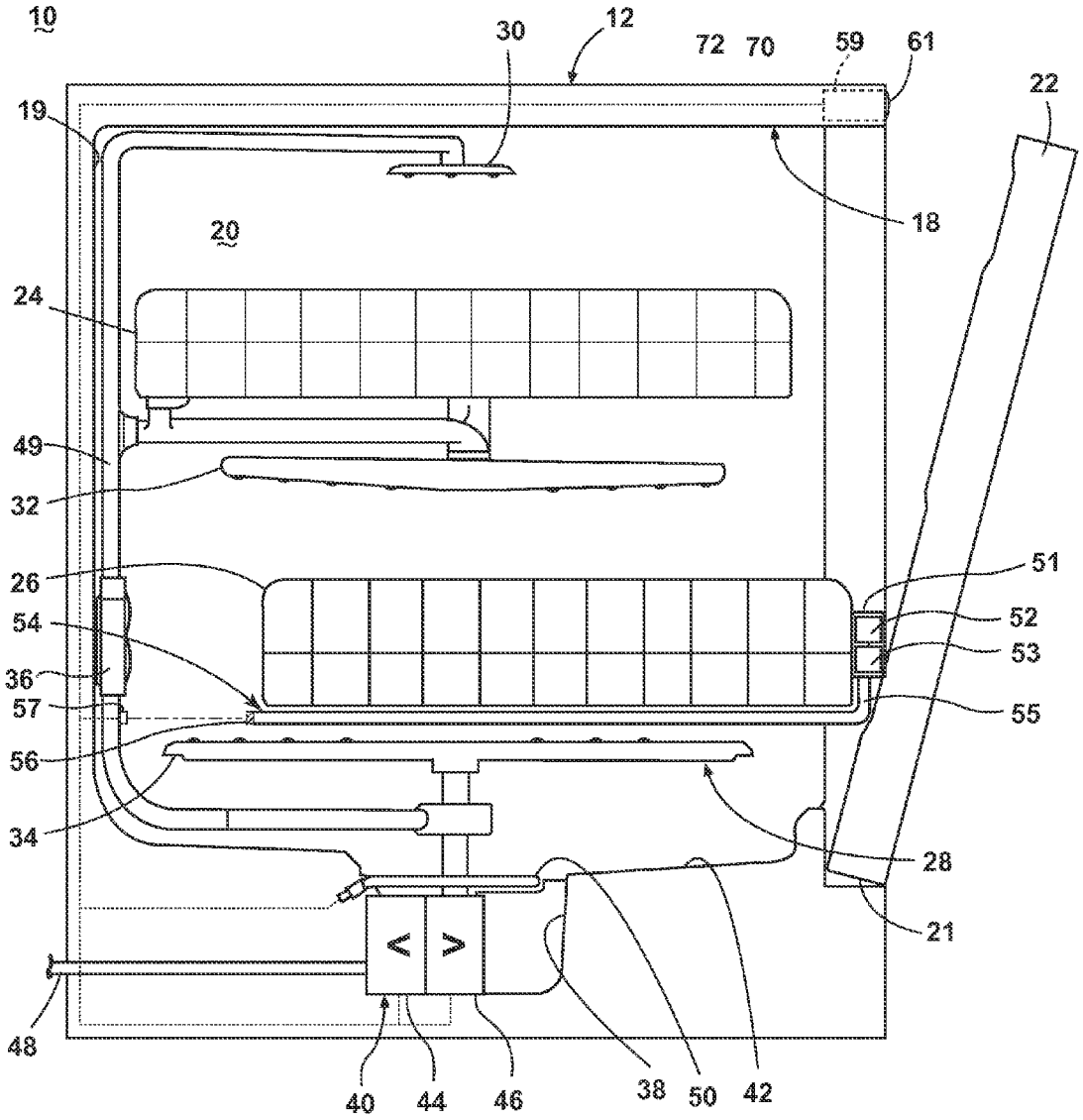
FIG. 3 is a schematic, side view of the dishwasher of FIG. 1, wherein the dishwasher is in a loading position.

FIG. 3 illustrates a schematic, side view of the dishwasher 10 of FIG. 1, wherein the dishwasher 10 is in a loading/unloading position. The charging of the rechargeable battery 53 may be discontinued when the battery 53 is electrically uncoupled to the battery charging system 54. When a cycle of operation is complete, the door assembly 21 may be opened to unload dishes from the treating chamber 20, or to load dishes into the treating chamber 20 for a cycle of operation, either of which may entail the movement of at least a portion of the lower rack 26 external to the treating chamber 20 to the loading/unloading position. When the lower rack 26 moves away from the rear wall 19, the first connector 56 of the electrical conduit 55, carried by the lower rack 26, may be disconnected from the second connector 57. As a result, the supply of electricity to the battery 53 through the electrical conduit 55 may be disconnected, and the charging of the battery 53 may be stopped.

Figure 4:
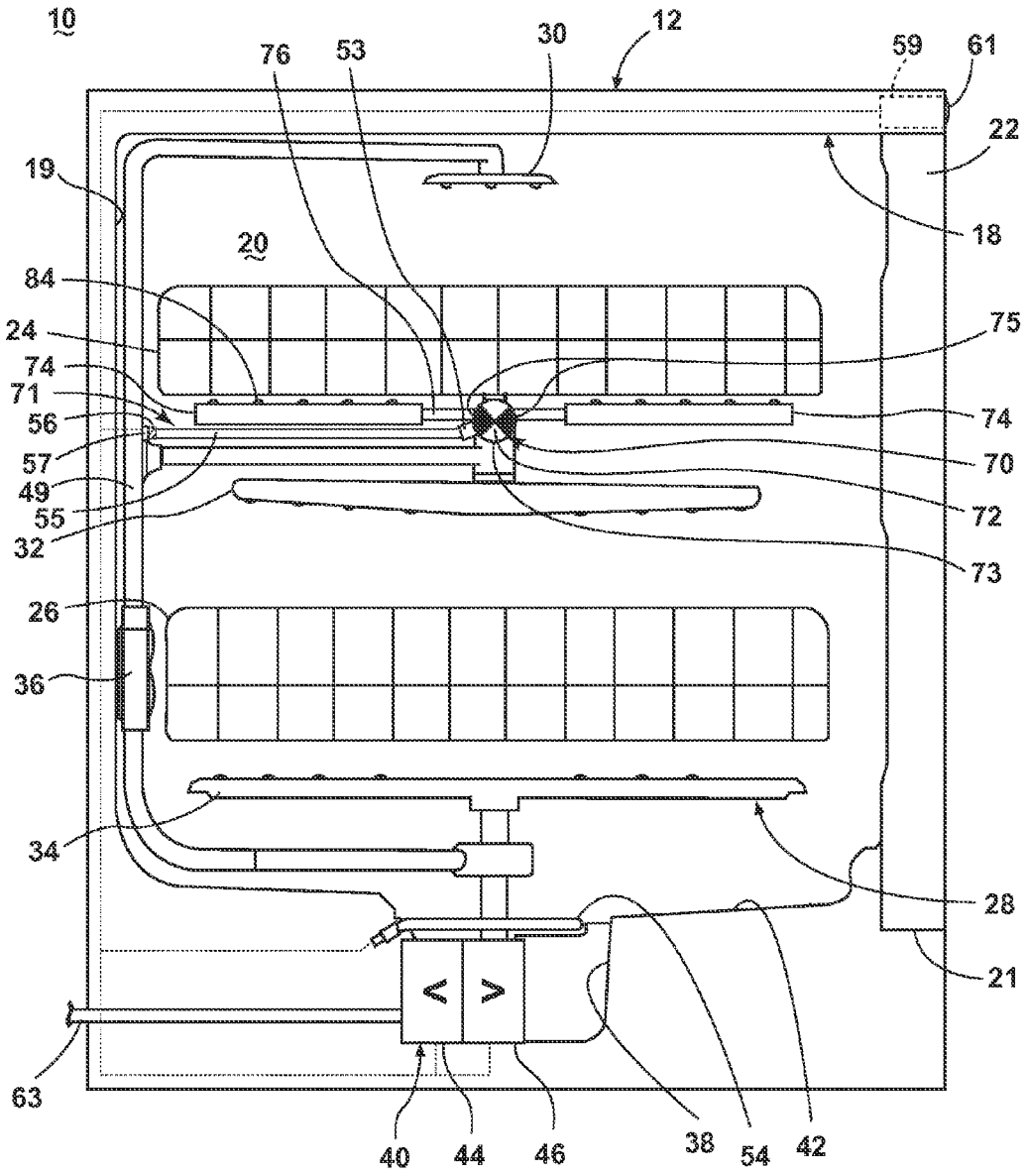
FIG. 4 is a schematic, side view of a dishwasher according to a second embodiment of the invention.

FIG. 4 is a schematic, side view of a dishwasher according to a second embodiment of the invention. The second embodiment is similar to the first embodiment, except that the electricity-consuming component comprises a liquid controller 70, instead of the dispenser 51. The liquid controller 70 also contains a battery 53 that is rechargeable in the same manner as battery 53 of the first embodiment using the battery charging system 71, electrical conduit 55, first and second connectors 56, 57.

The second embodiment further comprises supplementary sprayers 74 that are fluidly coupled to the liquid supply system via the supply tube 49. The liquid controller 70 may be used to control the flow of liquid from the liquid supply system to the supplementary sprayers 74 in any desired sequence or combination. The liquid controller 70 may also be used to control the supply of liquid to the sprayer 32. In this manner, the liquid controller 70 may be thought of as a controllable valve having at least one inlet with one or more outlets coupled to the supplementary sprayers 74 in the desired sequence and/or combination.

Figure 5:
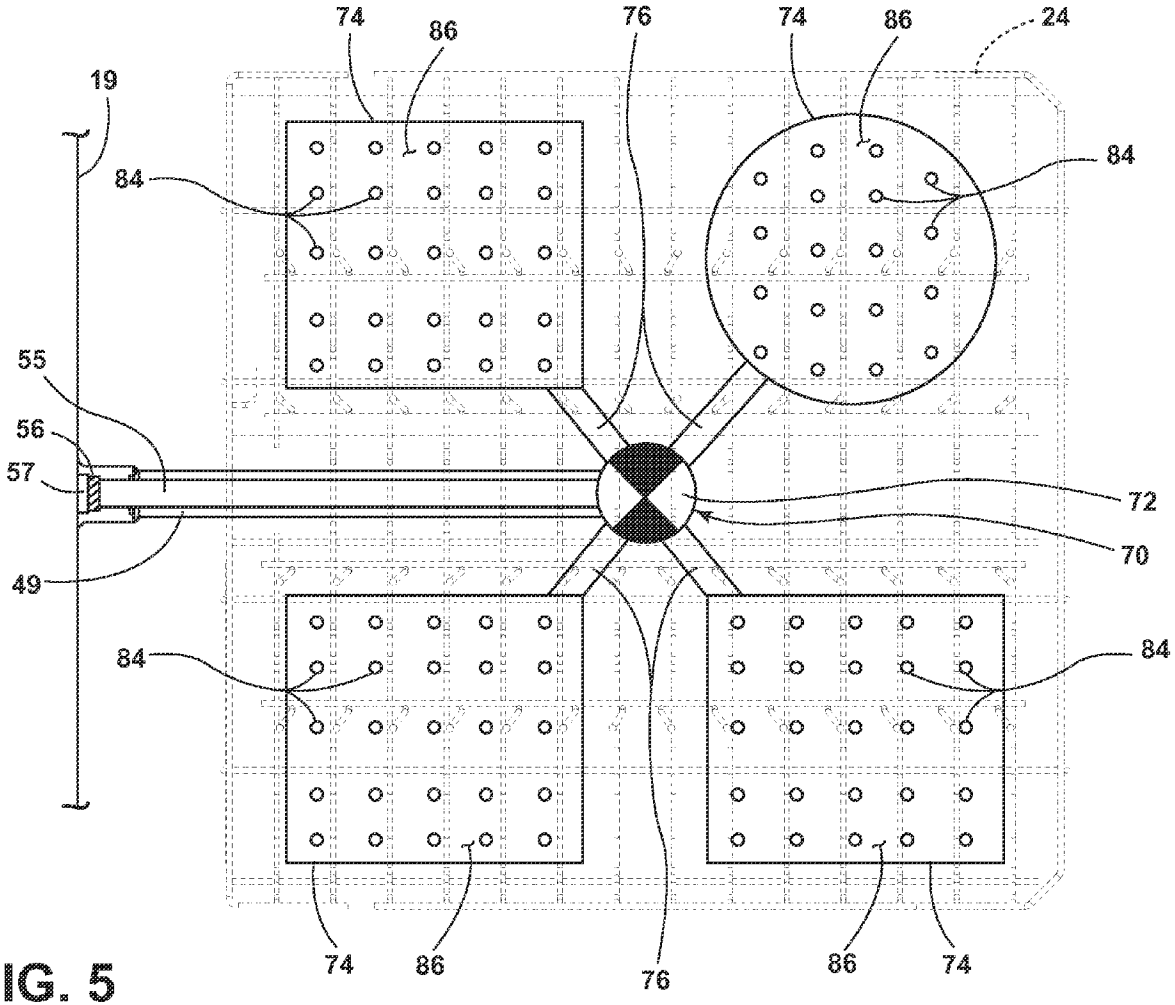
FIG. 5 is a schematic, top view of a liquid controller and supplementary sprayers defining spray zones in an upper rack of the dishwasher of FIG. 4.

Referring to FIG. 5, the supplementary sprayers 74 may have any desired shape, even though they are illustrated as having rectangular, square, and circular shapes. The supplementary sprayers 74 may include multiple nozzles 84 for spraying the liquid upwardly toward the bottom of the upper rack 24. While the liquid controller 70 and supplementary sprayers 74 may be coupled to the upper rack 24, it may be understood that they may be coupled to the lower rack 26 in another embodiment.

The liquid controller 70 may further include at least one inlet 73, and one or more outlets 75. The inlet 73 may be coupled to the supply tube 49 for receiving liquid, and one or more outlets 75 may be coupled to the liquid conduit 76 for supplying the liquid from the valve 72 to the supplementary sprayers 74.

The ability of the liquid controller 70 to control the sequence and/or combination of supplementary sprayers 74 being supplied liquid from the liquid supply system provides for the ability to have multiple, controllable wash zones in the upper rack 24, with a wash zone being defined, in most cases, by the sprayer, supplementary or rotating arm, currently being supplied liquid. If sufficient water flow is available or a particular selection of sprayers can be adequately supplied, it is possible for the liquid controller 70 to supply liquid to sprayers defining different spray zones 86, which may or may not vary in a liquid flow characteristic such as pressure, intensity, volume, flow rate, etc.

For the second embodiment, the operation of the recharging of the battery 53 relative to the movement of the rack 24 is the same as the first embodiment. That is, the sliding of the rack to the loading position uncouples the connectors 56, 57 to prevent charging and the sliding of the rack to the treating position couples the connectors and permits charging.

It may be noted that, similar to the dispenser 51 or valve 72 as described above, other components such as sensors or a light, may be coupled to one of the upper and lower racks 24, 26. For example, sensors may include the rechargeable batteries, which may be coupled to the battery charging system having the electric conduit having the first connector, and the second connector provided on one of the multiple walls of the tub 18 for charging the rechargeable batteries. The sensors may monitor the status of a cycle of operation, and/or transmit the signal indicative of the status of the cycle of operation consuming electricity supplied from the rechargeable battery.

Similarly, the light having a rechargeable battery and coupled to the battery charging system may be charged while the dishwasher 10 is in the treating position, and the light may be turned on when the dishwasher 10 in the loading position.

The invention described herein provides a method for supplying electrical components provided on the rack with electricity for charging the rechargeable batteries using the battery charging system. When in the treating position, the rechargeable batteries may be coupled to the battery charging system for charging. When in the loading position, the batteries may be uncoupled to the battery charging system for preventing further charging.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher for treating dishes according to an automatic cycle of operation, the dishwasher comprising:

a tub defining multiple walls that at least partially defines a treating chamber for receiving dishes for treating according to the cycle of operation and an open face providing access to the treating chamber;

a dish holder slidable relative to the tub through the open face between loading and treating positions;

a dispenser provided on the dish holder and having a rechargeable battery and wherein the dispenser is an electricity-consuming component used to dispense treating chemistry; and a battery charging system supplying electricity to the rechargeable battery and having an electrical conduit having a first connector carried with the dish holder and one end electrically coupled to the dispenser and a second connector provided with one of the multiple walls and coupled to a controller;

wherein the first and second connectors are disconnected and prevent supply of electricity through the electrical conduit when the dish holder is in the loading position and the first and second connectors are physically coupled and configured to form a conductive path to permit the supply of electricity from the controller through the electrical conduit, when the dish holder is in the treating position to recharge the rechargeable battery.

2. The dishwasher of claim 1 wherein the controller supplies electricity at a low voltage.

3. The dishwasher of claim 2 wherein the low voltage is a signal voltage.

4. The dishwasher of claim 3 wherein the low voltage is less than 5 volts.

5. The dishwasher of claim 1 wherein the controller further comprises a DC output that supplies the electricity.

6. The dishwasher of claim 1 wherein the controller is configured to turn on or turn off a signal to control the charging of the rechargeable battery.

7. The dishwasher of claim 1 wherein the dispenser is configured to dispense treating chemistry while consuming electricity supplied from the rechargeable battery.

8. A dishwasher for treating dishes according to an automatic cycle of operation, the dishwasher comprising:

a tub defining multiple walls that at least partially defines a treating chamber for receiving dishes for treating according to the cycle of operation and an open face providing access to the treating chamber;

a dish holder slidable relative to the tub through the open face between loading and treating positions;

a sensor provided on the dish holder and having a rechargeable battery; and a battery charging system supplying electricity to the rechargeable battery and having an electrical conduit having a first connector carried with the dish holder and a second connector provided with one of the multiple walls and coupled to an electricity source configured to be coupled to an AC power supply and having a DC output;

wherein the first and second connectors are disconnected and prevent supply of electricity through the electrical conduit when the dish holder is in the loading position and the first and second connectors are physically coupled and configured to form a conductive path to permit the supply of electricity from the electricity source through the electrical conduit, when the dish holder is in the treating position to recharge the rechargeable battery.

9. The dishwasher of claim 8 wherein the sensor comprises at least one of a pH sensor, a humidity sensor and a temperature sensor.

* * * * *